US005381926A

United States Patent [19]

Credle, Jr. et al.

[11] Patent Number: 5,381,926

[45] Date of Patent: Jan. 17, 1995

[54] BEVERAGE DISPENSING VALUE AND METHOD

[75] Inventors: William S. Credle, Jr., Stone Mountain; Robert D. Hughes, IV, Atlanta, both of Ga.

[73] Assignee: The Coca-Cola Company, Atlanta, Ga.

[21] Appl. No.: 60,898

[22] Filed: May 12, 1993

Related U.S. Application Data

[63] Continuation-in-part of Ser. No. 893,639, Jun. 5, 1992, abandoned.

[51] Int. Cl.[6] ..... B67D 5/56

[52] U.S. Cl. ..... 222/1; 222/129.2; 222/145

[58] Field of Search ..... 222/1, 129.1, 129.2, 222/129.3, 129.4, 136, 137, 145, 249, 252; 137/98, 99

[56] References Cited

U.S. PATENT DOCUMENTS

| | | | |
|---|---|---|---|
| 2,392,449 | 1/1946 | Austin . | |
| 3,235,348 | 2/1966 | Witcher . | |
| 3,283,957 | 11/1966 | Henderson . | |
| 3,370,759 | 2/1968 | Johansson . | |
| 3,520,448 | 7/1970 | Russell . | |
| 3,865,126 | 2/1975 | Baggaley . | |
| 4,194,650 | 3/1980 | Nottke et al. . | |
| 4,275,823 | 6/1981 | Credle, Jr. | 222/136 |
| 4,369,805 | 1/1983 | Tavor . | |
| 4,370,996 | 2/1983 | Williams . | |
| 4,440,030 | 4/1984 | Pounder et al. . | |
| 4,445,781 | 5/1984 | Arena et al. . | |
| 4,487,333 | 11/1984 | Pounder et al. . | |
| 4,554,939 | 11/1985 | Kern et al. . | |
| 4,625,572 | 12/1986 | Yamashita . | |
| 4,649,809 | 3/1987 | Kanezashi | 222/129.4 |
| 4,886,190 | 12/1989 | Kirschner et al. . | |
| 4,901,886 | 2/1990 | Kirschner | 222/1 |
| 4,955,284 | 9/1990 | Faulkner . | |
| 4,966,306 | 10/1990 | Credle, Jr. et al. . | |
| 4,967,936 | 11/1990 | Bingler . | |
| 5,060,824 | 10/1991 | Credle, Jr. . | |
| 5,071,038 | 12/1991 | Credle, Jr. | 222/136 |
| 5,121,855 | 6/1992 | Credle, Jr. | 222/136 |
| 5,124,088 | 6/1992 | Stumphauzer | 222/129.1 |

FOREIGN PATENT DOCUMENTS

| | | |
|---|---|---|
| 0253406 | 1/1988 | European Pat. Off. . |
| 1217232 | 5/1966 | Germany . |

*Primary Examiner*—Stephen P. Avila
*Attorney, Agent, or Firm*—Thomas R. Boston

[57] ABSTRACT

A post-mix beverage dispensing valve for dispensing syrup and soda in the desired ratio without the need for flow controls for periodic adjustment of the ratio. The valve includes a flow meter for measuring the flow rate of the soda and a pump for dispensing metered quantities of syrup. The pump preferably includes a chamber within a ceramic sleeve having first and second distal ends and a double-acting ceramic piston mounted for reciprocating sliding movement within the sleeve. A solenoid valve control system including a pair of solenoid valves controls syrup flow through the pump, in response to signals from the flow meter. The valve preferably also includes a syrup flow regulator. The valve can include a single externally manually adjustable flow rate control to vary the dispensing flow rate to any desired value.

52 Claims, 12 Drawing Sheets

BEVERAGE DISPENSING VALUE AND METHOD

CROSS-REFERENCE TO RELATED INVENTION

This is a continuation-in-pan of copending application Ser. No. 07/893,639, filed on Jun. 5, 1992, (now abandoned) entitled Volumetric Valve and having the same inventors as this application.

BACKGROUND OF THE INVENTION

The present invention relates to a post-mix beverage dispensing valve for dispensing concentrate (such as syrup) and diluent (such as soda water) in controlled volumetric proportions. More specifically, the present invention relates to an apparatus and method for injecting metered quantities of syrup or concentrate into measured quantities of diluent flowing through a diluent supply conduit.

Post-mix beverage dispensing valves typically dispense syrup and a diluent such as carbonated water (soda) simultaneously through a mixing nozzle into a beverage cup. To obtain the proper mixture ratio, current valves control the flow rate of the syrup and soda often with the use of manually-adjustable flow controls. These flow controls do not always achieve a proper mixture ratio because: a change in flow rate in one fluid does not cause a corresponding flow rate change in the other fluid; the flow controls can be individually misadjusted in the field any time by anybody; and the flow controls do not stay in proper adjustment over an extended period of time.

Attempts have been made to solve these problems by linking the syrup and diluent flow rates together. However, none of these valves have been completely successful to date. Three types of "linked" valves which have not proven to be completely successful are described below.

A first type of linked valve is one which monitors syrup and soda flow with flow meters and controls the flow in the respective supply conduits with pulsating solenoids. This type of valve has proven to be too complex, too expensive, and often unreliable.

A second type of linked valve uses reciprocating pistons linked together to control syrup and soda flow. This type of valve has difficulty in achieving a high flow rate in a small package; produces casual drink temperatures which are too high; and has problems with the seals that separate the syrup and the soda chambers.

A third type of linked valve includes rotary volumetric pumping chambers mechanically linked with a common shaft. This type of valve experiences problems with fluid slippage through the device and with the seals that separate the syrup and soda chambers of the respective pumping chambers.

Accordingly, there is a need in the an for an improved apparatus for supplying metered volumes of concentrate and diluent in controlled proportions to the mixing station of a post-mix beverage dispenser.

SUMMARY OF THE INVENTION

The present invention provides an apparatus for dispensing metered volumes of concentrate and diluent in controlled proportions in a beverage dispenser to produce a post-mix beverage comprising:

a first conduit for accommodating a flow of diluent to the dispenser;

a second conduit for accommodating a flow of concentrate to the dispenser;

flow meter means for measuring a flow rate of diluent in the first conduit and determining a quantity of diluent flowing over a given time interval;

pump (or metering) means in liquid communication with said second conduit for injecting metered quantities of concentrate into said diluent at said mixing station, said pump means including, a chamber defined by sleeve, said chamber having first and second distal ends, and a double acting piston mounted for reciprocating sliding movement within said sleeve between the distal ends; and a solenoid valve control system including a pair of solenoid valves for alternately directing concentrate from said second conduit into the chamber on opposite sides of said piston in response to measurement by said flow meter means of a quantity of diluent flow of a predetermined value, to thereby alternately slide said piston in said chamber from one distal end to the other each time the predetermined value is measured, and alternately dispensing concentrate from said chamber to said mixing station from the other side of the piston from which the concentrate is being directed;

whereby a fixed volume of concentrate from said chamber is dispensed with each quantity of diluent of said predetermined value.

In a preferred embodiment the sleeve defining the chamber of the pump means is fabricated from a ceramic material as is the double-acting piston. The opposed walls of the piston and chamber are manufactured with very close clearances so that they are in close sliding contact, and there is no need for any additional sealing means therebetween. For this reason the piston pump with the ceramic components is extremely responsive and fast acting. Furthermore, there is no need for additional dynamic seals which are subject to wear and sticking. Dynamic seals are of course a potential problem because: syrup pressures are sometimes too low to overcome breakaway friction of the seals; and syrup formulas of different types cause seals to swell, creating higher frictional forces.

One example of a flow meter for use with the present invention comprises a housing fluidly connected in the diluent conduit for passing the diluent therethrough, a paddle wheel disposed in the housing in the flow path of the diluent and rotatable in response to the flow thereof, and sensor means for measuring the rate of rotation of the paddle wheel and generating a series of electrical pulses spaced in proportion to the rate of rotation of the paddle wheel. A counter is provided for counting the electrical pulses and generating a trigger signal to switch the valve means to opposite first and second positions when the number of pulses counted reaches a threshold number related to the quantity of diluent of the predetermined value.

The counter may be adjustable either in the factory or in the field to vary the ratio of the syrup to diluent being mixed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and, thus, are not limitative of the present invention and wherein.

DETAILED DESCRIPTION OF THE PREFERRED EMBODIMENT

Figure 1:
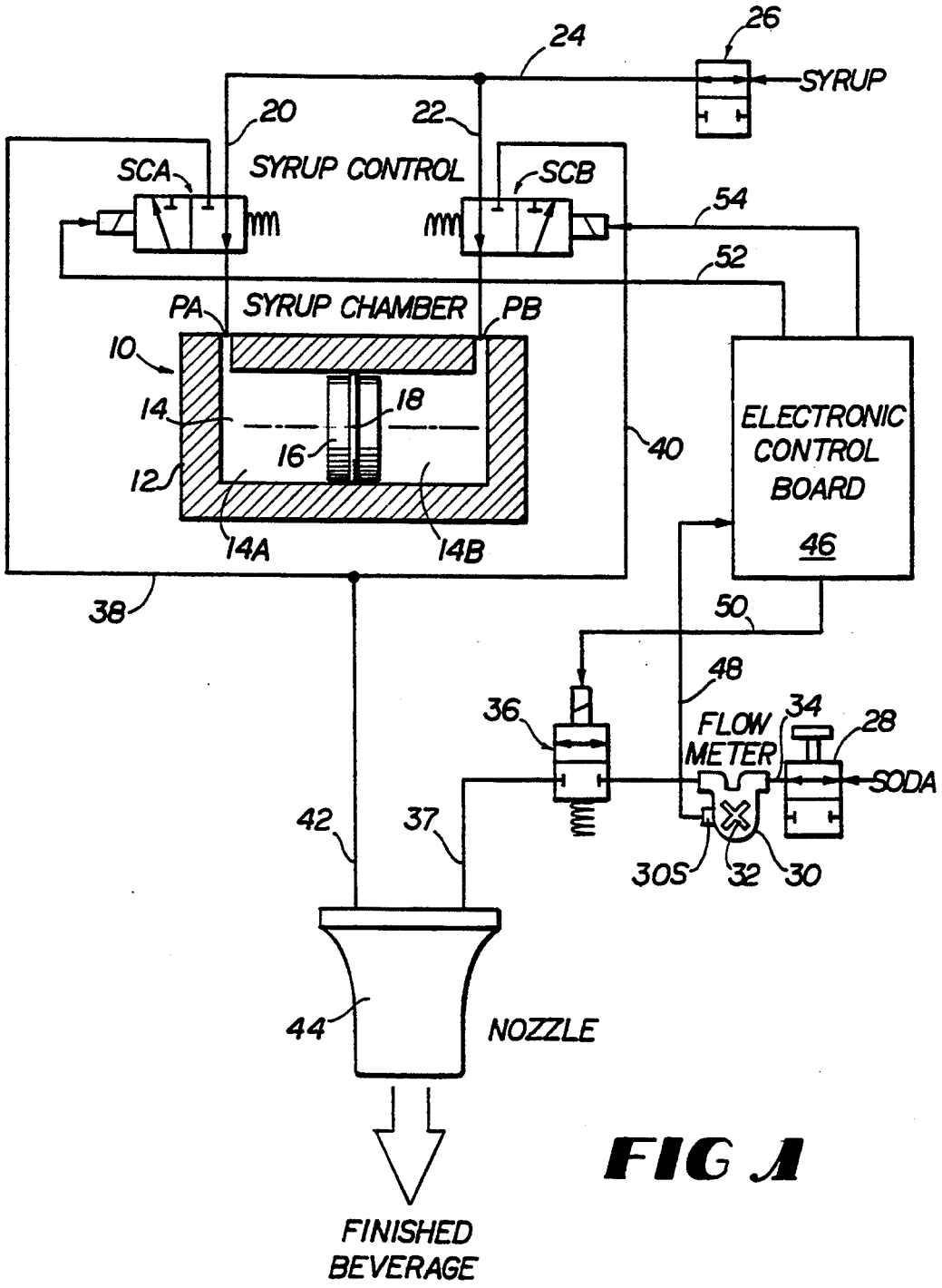
FIG. 1 is a schematic diagram illustrating the components and operation of the apparatus and method of the present invention.

Referring to FIG. 1 there is illustrated a volumetric dispensing pump 10 comprised of a cylindrical sleeve 12 and a reciprocating slidable piston 16 disposed therein. Piston 16 divides a pump chamber 14 defined by sleeve 12 into separate portions 14A, 14B. In the schematic illustration of FIG. 1 a dynamic 0-ring seal 18 is provided between the peripheral surfaces of piston 16 and the inner walls of cylindrical sleeve 12. However, as will become more apparent hereinafter, dynamic seals are eliminated by fabricating the cylindrical sleeve and the piston 16 of ceramic material with very close clearances therebetween. Communicating with the pump chamber are fluid inlet passages 20 and 22 which are connected to a syrup supply conduit 24. A manually actuable valve 26 is provided in conduit 24 to open and close the syrup conduit as needed. Pump 10 has inlet/-outlet ports PA and PB in liquid communication with passages 20 and 22. Solenoid valves SCA and SCB of the same type are disposed in liquid circuit with passages 20 and 22. Each of these solenoid valves are actuable between first and second positions in response to control signals received from electronic control board 46 via control lines 52, 54 in a manner to be described hereinafter. Each valve when in a first position permits syrup flow therethrough from conduit 24 into pump chamber 14. Each valve when in a second position permits syrup flow therethrough from chamber 14 into mixing nozzle 44.

That is, solenoid valves SCA and SCB control the egress of syrup from pump chambers 14A and 14B into outlet passages 38 and 40 commonly connected to outlet conduit 42 in liquid communication with the mixing nozzle 44.

A diluent or soda supply line 34 is provided with appropriate valves such as manually actuable valve 28 and a solenoid valve 36 Also provided within soda conduit 34 is a flow meter 30 having a rotatable paddle wheel 32 and associated electronic sensor for sending signals to an electronic control board which determines the flow rate and therefore quantity of soda flowing through conduit 34 over a given time interval. Soda flowing through conduit 34, flow meter 30 and solenoid 36 passes through conduit portion 37 into a mixing nozzle 44 wherein it may be mixed with syrup dispensed from pump 10.

Electronic control board 46, which may take various forms, includes electronic circuitry for controlling the operation of the system of FIG. 1. It is connected to flow meter 30 via line 48; to solenoid 36 via line 50, and as stated above to solenoids SCA and SCB via lines 52 and 54, respectively. Details of control board 46 are illustrated and described in connection with FIG. 5.

The operation of the system illustrated in FIG. 1 will now be described.

The schematic of FIG. 1 shows the system in its deactivated state wherein solenoid syrup valves SCA and SCB are both in their deenergized position and syrup of substantially equal pressure from supply conduit 24 is supplied through passages 20, 22 and ports PA, PB into chambers 14A, 14B on opposite sides of piston 16. The piston 16 is shown in the middle of the chamber 14, but as will be described below, the piston will stop at whatever position it is in when the dispense operation is done and the valve is deactivated. To begin a dispensing operation solenoid valve 36 (for example) is activated to an energized or open position. Both manual valves 26 and 28 are also open. At this time valves SCA and SCB are in opposite states, one deenergized and one energized. Soda or diluent will then begin to flow through flow meter 30 causing the paddle wheel 32 to rotate. The rotation of the paddle wheel is measured by a sensor to be described further hereinafter with reference to FIG. 3 and appropriate pulse signals spaced according to soda flow rate are sent to electronic control board 46 through line 48.

Figure 5:
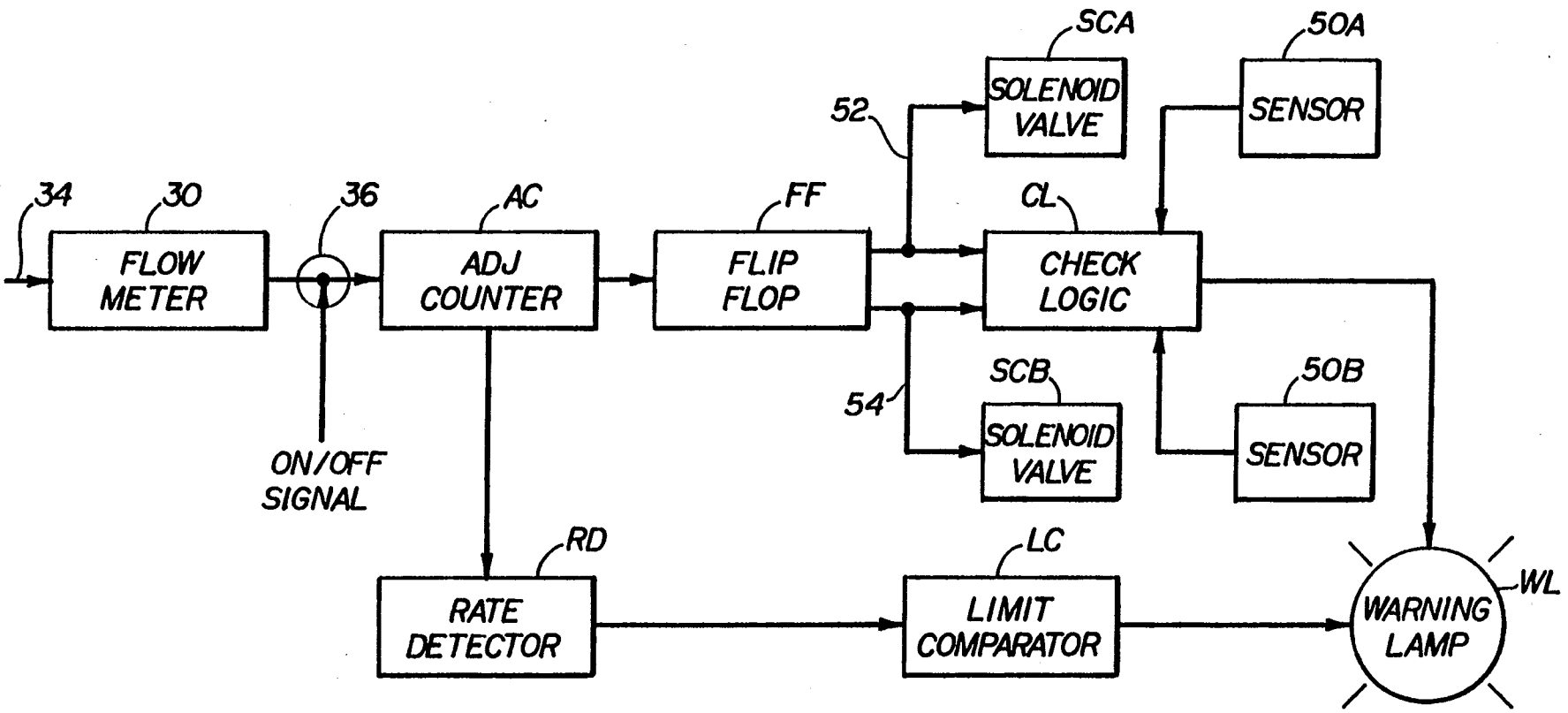
FIG. 5 is a schematic block diagram of the electronic control board portion of FIG. 1.

As illustrated in FIG. 5 electronic control board 46 may include inter alia an adjustable counter AC, and a flip-flop FF. Counter AC counts the pulses generated by the paddle wheel 32 and associated sensor 30S which are proportionally spaced according to the flow rate of soda in line 34. Counter AC is adjusted to generate a trigger signal when a predetermined count (a preset threshold count) is reached that corresponds to a predetermined quantity of soda flowing over a given time interval. Counter AC may be adjusted to any desired value.

Once the counter reaches the threshold count to which it is adjusted, it generates a trigger signal to flip-flop FF which changes its state to energize either solenoid SCA or SCB. In this scenario power would not be applied through line 52 and solenoid valve SCA is in its de-energized first position to permit syrup to flow through passage 20 and port PA in pump chamber 12 into chamber 14A. At this point in time piston 16 would be disposed adjacent the left hand distal end of chamber 14 in cylindrical sleeve 12 as viewed in FIG. 1, and the supply of syrup under pressure through passage 20 would drive piston 16 toward the fight and the opposite distal end of cylindrical sleeve 12 to force any syrup within chamber 14B out of port PB through energized solenoid valve SCB, passages 40 and 42 and into mixing nozzle 44. This cycle is repeated when each threshold count is reached. That is on the next cycle solenoid SCB will be de-energized and switched to its first position and solenoid SCA energized and switched to its second position. Syrup will then flow into chamber 14B forcing piston 16 toward the left distal end of the sleeve 12 and syrup will be pumped out of port PA through valve SCA to nozzle 44. Therefore, a volumetrically measured portion of syrup will be mixed with the soda passing into mixing nozzle 44 in a controlled ratio. Every time predetermined count is reached by the counter AC, a trigger signal will cause flip-flop FF to change states, reverse the switching conditions of switches SW1 and SW2 and the respective positions of solenoid valves SCA and SCB. This will cause the piston 16 to be propelled by syrup toward the opposite distal end of chamber 12 from where it is located and to dispense an additional volumetrically controlled portion of syrup to nozzle 44.

Solenoid valves SCA and SCB during a dispensing cycle are always in opposite ones of first and second states wherein in one cycle one of the valves in a first position permits syrup to flow therethrough into the chamber defined by pump sleeve 12 and the other valve in a second and opposite position permits syrup to flow out of the pump chamber from the opposite side of the piston to the mixing nozzle 44.

In the succeeding cycle the states of valves SCA and SCB are reversed.

Figure 2:
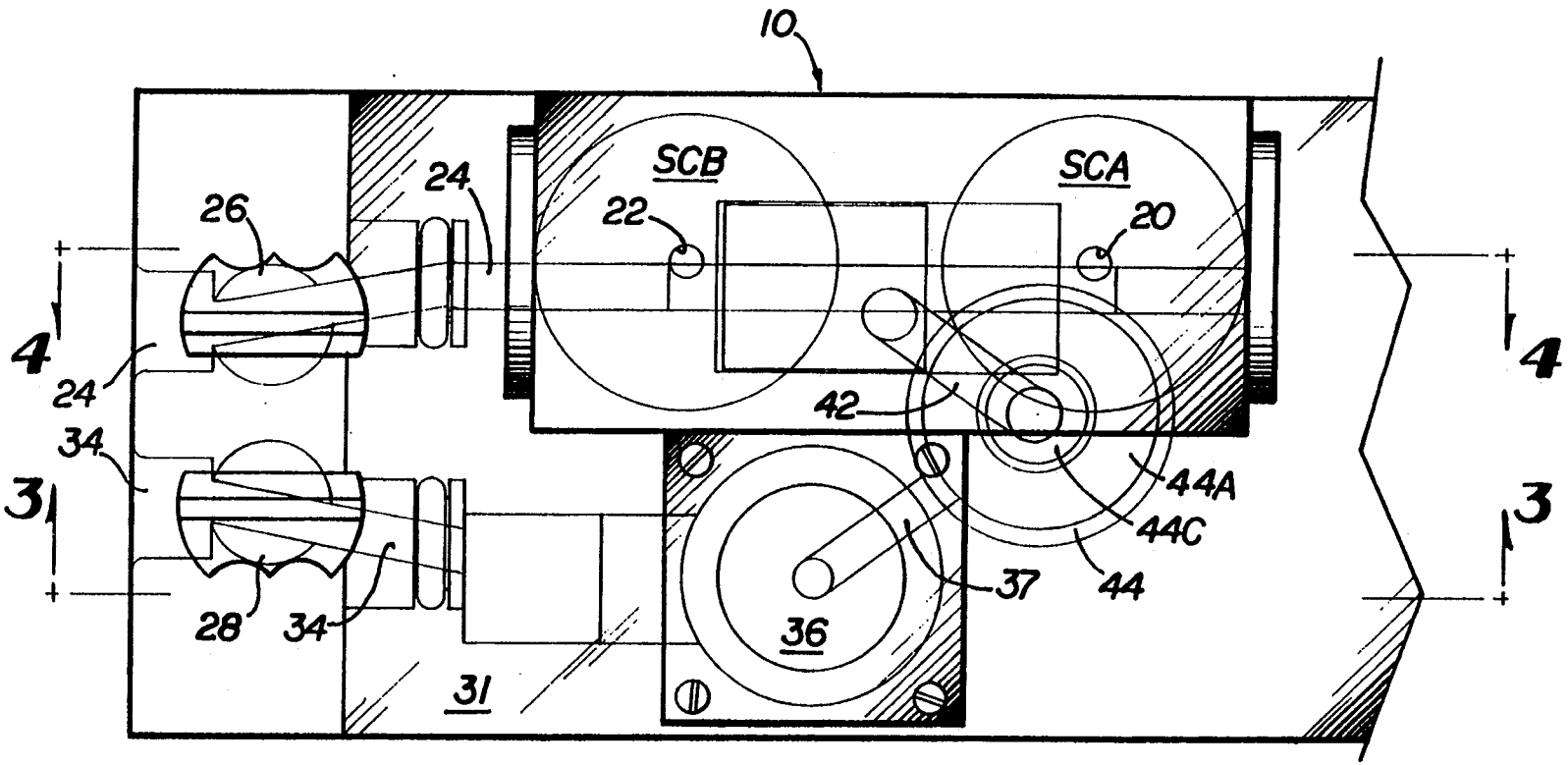
FIG. 2 is a top plan view of a preferred embodiment of the volumetric valve apparatus of the present invention.
Figure 3:
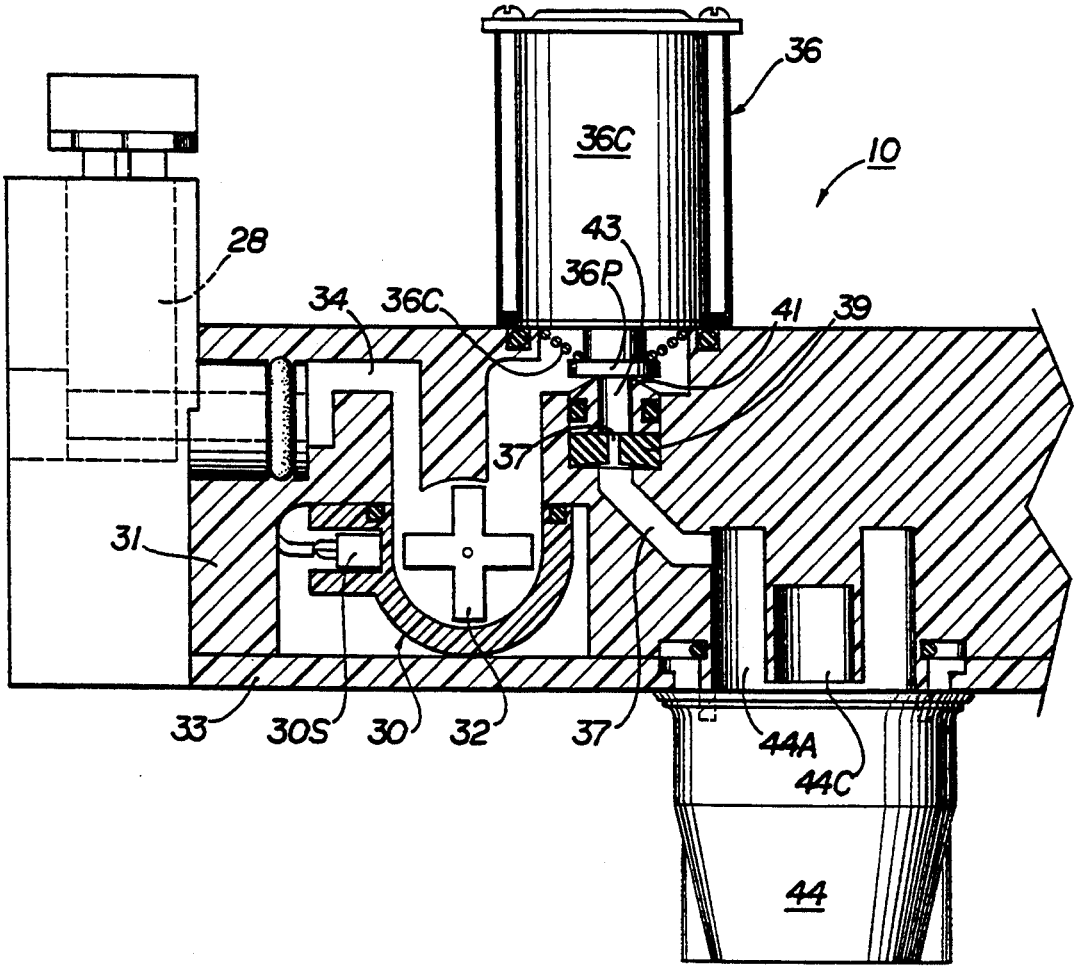
FIG. 3 is a cross-sectional view taken along line 3—3 of FIG. 2.
Figure 4:
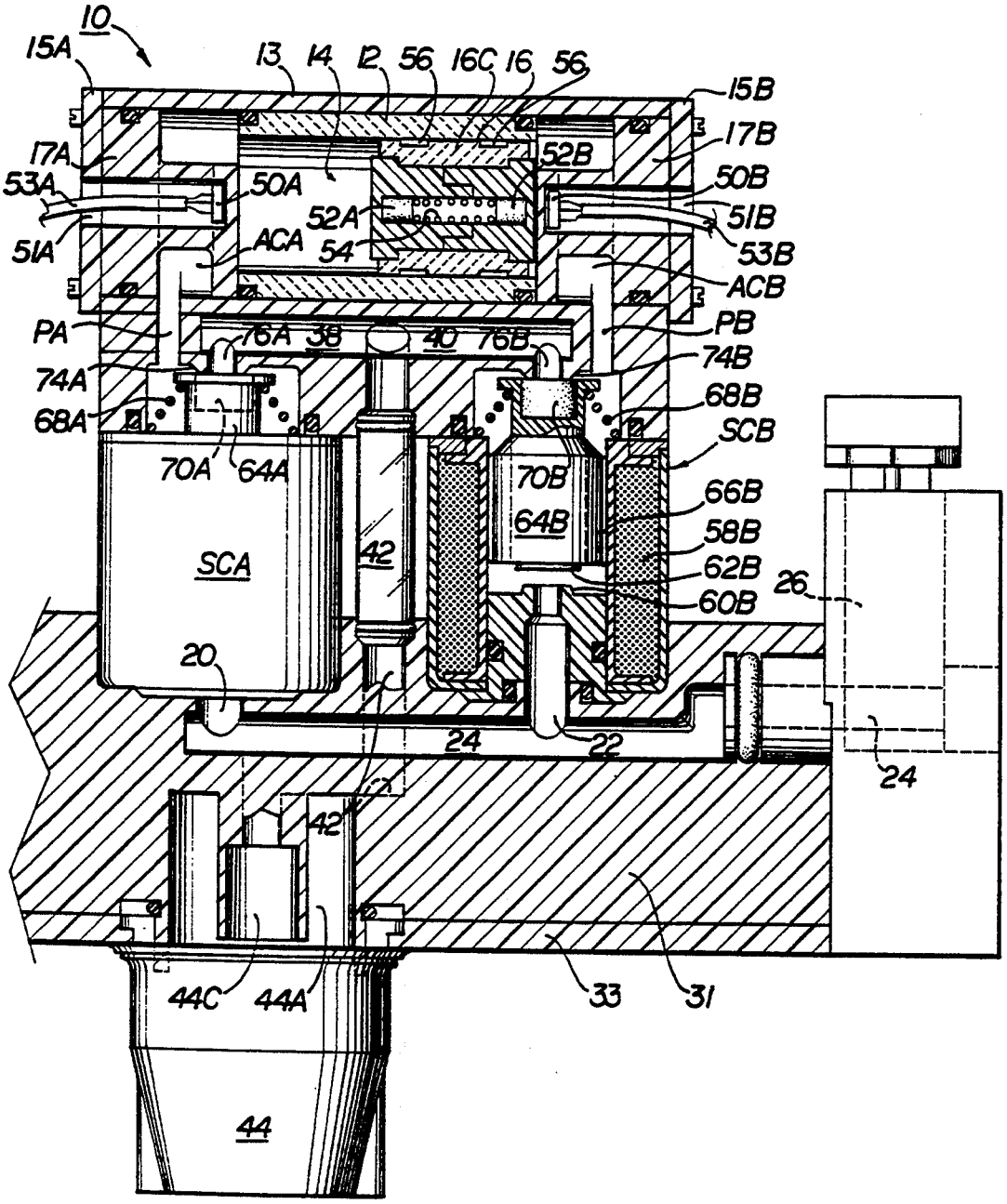
FIG. 4 is a cross-sectional view taken along line 4—4 of FIG. 2.

One embodiment of the mechanical construction of the volumetric valve and flow meter assembly illustrated in FIG. 1 is set forth in detail in FIGS. 2 to 4. The assembly includes a main manifold block 31 containing appropriate cavities and flow channels for various portions of the system shown in FIG. 1. A bottom plate 33 is secured to block 31 for removably containing flow meter 30 and mixing nozzle 44 in associated cavities in the bottom of block 31. This is best shown in FIG. 3 which illustrates flow meter 30 including rotary paddle wheel 32 and photosensor 30S disposed in a cavity in the bottom of block 31 in liquid communication with diluent conduit 34. Manually actuable valve 28 is also mounted in mounting block 29 at the input end of conduit 34. Downstream of the flow meter 30 in conduit 34 is solenoid soda valve 36 including a coil 36C having a plunger 36P which operatively engages a valve seat 41 surrounding a port 43. Just below port 43 is an orifice plate 39 in communication with flow passage 37 fluidly connected to annular chamber 44A of mixing nozzle 44.

Referring to FIG. 2 it can be seen that syrup conduit 24 is also formed in block 31. Manually actuable valve 26 is provided adjacent the input end of conduit 24 for starting or stopping the flow of syrup through conduit 24. Conduit 24 connects with vertical passages 22 and 20 leading through solenoid valves SCB and SCA, respectively. These solenoid valves are disposed in cavities formed in the top of block 31 and extend upwardly into engagement with a manifold head for metering pump 10 illustrated in detail in FIG. 4. Included within this manifold head is a horizontally extending conduit including branches 38 and 40 which communicate with a vertical conduit 42 extending from the manifold head through block 31 into chamber 44C in mixing nozzle 44. Branch 38 has a port 76A formed therein defining a valve seat 74A about the perimeter thereof disposed for operative association with a valve element 70A in the end of reciprocating plunger 64A of valve SCA. Branch 40 has a like port 76B formed therein surrounded by a valve seat 74B in operative association with a valve element 70B in the end of plunger 64B of solenoid valve SCB.

The pump manifold head also includes input/output ports PA, PB in liquid communication with annular chambers ACA and ACB in the ends of pump 10.

Solenoid valves SCA and SCB are substantially identical in construction and operation. Valve SCB is shown in cross-section in order to illustrate the details of its components and the corresponding components of valve SCA. Valve SCB includes an electromagnetic coil 58B, a plunger 64B, a return spring 68B, channels 66B in a fluted surface of plunger 64B, a first valve element 70B in one end of the plunger and a second valve element 62B in the other or bottom end of the plunger. Valve element 70B opens or closes port 76B and valve element 62B opens or closes a port in passage 22 surrounded by a valve seat 60B in response to the energization state of valve SCB. Valve SCB and valve SCA are shown in their de-energized state in FIG. 4 but in operation these valves would always be in opposite states. That is, if the plunger 64B of valve SCB is up in a first position the corresponding plunger 64A in valve SCA would be down in its second position.

It can be seen that with the solenoid valves SCA and SCB in their de-energized state that fluid flow paths exist for example between syrup conduit 24 through passage 22, channel 66B and port PB to annular chamber ACB in fluid communication with chamber 14 within pump 10. In a second position when plunger 64B energized and moved downwardly against return spring 68B passage 22 is sealed off by valve element 62B and annular chamber ACB in the end of pump 10 communicates through port PB, port 76B, flow branch 40, and vertical conduit 42 to chamber 44C of mixing nozzle 44.

Since valve SCA is identical to valve SCB its operation and flow paths to and from annular chamber ACA of pump 10 are as described with respect to solenoid valve SCB. That is, when valve SCA is de-energized syrup will flow through passage 20 and the plunger of solenoid valve SCA through port PA into annular chamber ACA and into pump chamber 14. In the energized state of solenoid valve SCA syrup will flow out of chamber 14 through annular chamber ACA, port PA, port 76A, flow branch 38 and vertical conduit 42 into chamber 44C in mixing valve 44.

The construction of pump 10 includes an outer cylindrical housing 13 including end plugs 17A, 17B shaped to define annular chambers ACA and ACB, respectively. End plugs 17 also include central bores 51A, 51B for accommodating Hall Effect sensors 50A, 50B. These sensors are provided with output wires 53A, 53B connected to the control board.

Sensors 50A, 50B are proximity detectors for determining whether reciprocating piston 16 reaches the respective ends of pump chamber 14 during operation. Magnets 52A, 52B are provided in the distal ends of piston 16, and are spaced apart by a coil spring 54. These magnets 52A, 52B generate magnetic fields which are sensed by HALL Effect sensors 50A, 50B whenever the magnets and, therefore, piston 16 are in close proximity with the end walls defining pump chamber 14. Sensors 50A, 50B are in circuit with a warning lamp WL and check logic CL associated with the electronic control board 46 of FIGS. 1 and 5 to generate warning signals if piston 16 is not reaching the ends of chamber 14 within pump 10. That is, if the pump is not operating correctly and the piston is not reaching its respective distal ends of chamber 14, a warning signal would be generated by the signal lamp, such as a flashing of the signal lamp to inform an operator that the concentrate pressure should be increased. Check logic circuit CL is coupled to the outputs of flip-flop FF so that it can determine which solenoid is energized and, therefore, which of sensors 50A, 50B should be receiving signals from magnets 52A, 52B.

Plugs 17A, 17B are held in the ends of cylinder 13 by cover plates 15A, 15B which are suitably bolted or screwed to housing 13.

Pump 10 includes an improved construction including a liner sleeve 12 formed of ceramic material and an associated piston sleeve 16C formed of ceramic material in close sliding contact therewith. Sleeve 16C has fluted channels 56. However, no dynamic external seals are provided because the respective ceramic pans manufactured with close clearances are self-sealing. This provides a significant improvement in reliability and response time for reciprocating piston 16.

The operation of the valving and flow meter assembly of FIGS. 2 to 4 is essentially the same as that described with respect to FIG. 1 wherein like reference numerals refer to like parts.

When the valve assembly is not actuated, all solenoids are de-energized and the counter AC of FIG. 5 disregards pulses from the photosensor 30S. When the valve assembly is actuated, the following functions occur simultaneously:

The soda solenoid 36 is energized.

The counter AC totalizes the photosensor 30S pulses beginning with the last count of the previous draw. If the pulse rate counted is less than 100 per second or more than 500 per second, after the soda valve has been actuated for one second this is sensed by rate detector RD and limit comparator LC of FIG. 5 and a warning light WL is illuminated to warn an operator that the soda flow is not within acceptable limits. Preferably the warning light is the same warning light actuable by the Hall Effect sensors 50A, 50B but it is actuated in a non-blinking mode in order to distinguish it from signals from the Hall Effect sensors. The selective actuation of warning light SL in a blinking or non-blinking mode is controlled by warning signal generator of any suitable design.

The syrup solenoid last energized (SCA or SCB) from the previous draw is energized while the other syrup solenoid remains de-energized.

After a preset threshold count is reached, the following functions occur simultaneously:

- the counter AC resets and starts a new count;
- the syrup solenoid that was energized (SCA or SCB) is de-energized;
- the syrup solenoid that was de-energized is energized; and
- if Hall Effect sensors 50A, 50B and check logic CL determine that the syrup piston 16 has not reached the end of its stroke within pump chamber 14 before the preset threshold count is reached, the warning light WL is illuminated in a blinking mode.

This cycle is repeated as long as the solenoid valve 36 is actuated. When solenoid valve 36 is deactuated or de-energized the following functions occur simultaneously:

- the counter AC disregards pulses from the photosensor 30S;
- all solenoids are de-energized; and
- the electronic control board 46 remembers the last flow meter count and the last syrup solenoid that was energized.

Figure 7:
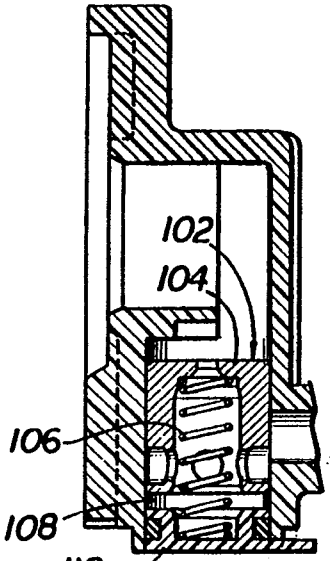
FIG. 7 is a partial cross-sectional view as in FIG. 6 but showing the flow regulator moved to a different position.
Figure 8:
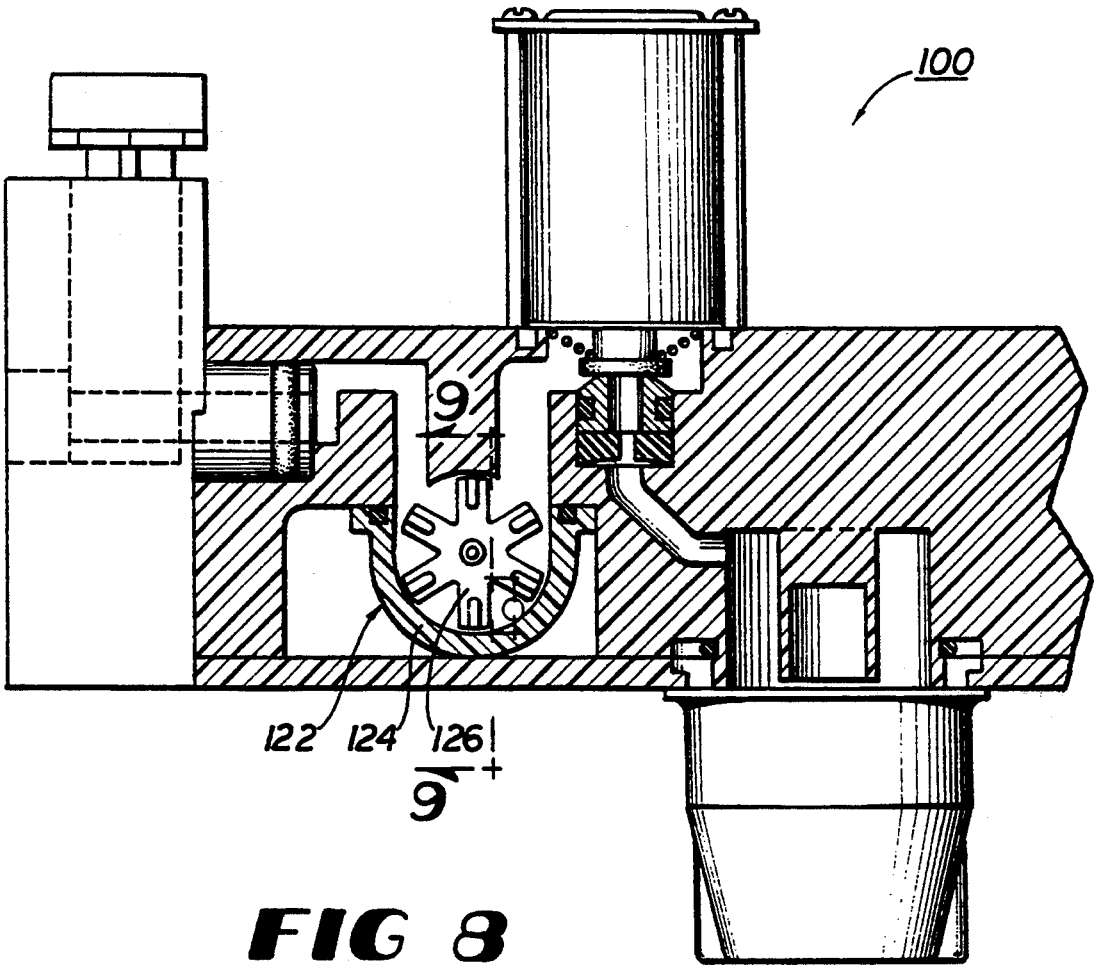
FIG. 8 is a cross-sectional view similar to FIG. 3 but showing a preferred flow meter.
Figure 9:
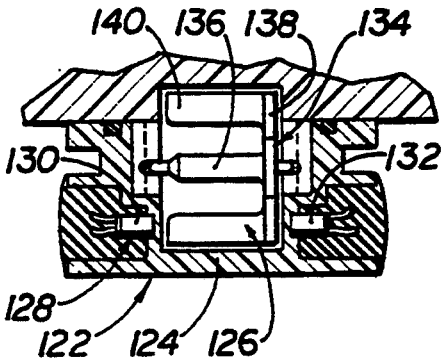
FIG. 9 is an end view of the flow meter showing the sensors.
Figure 10:
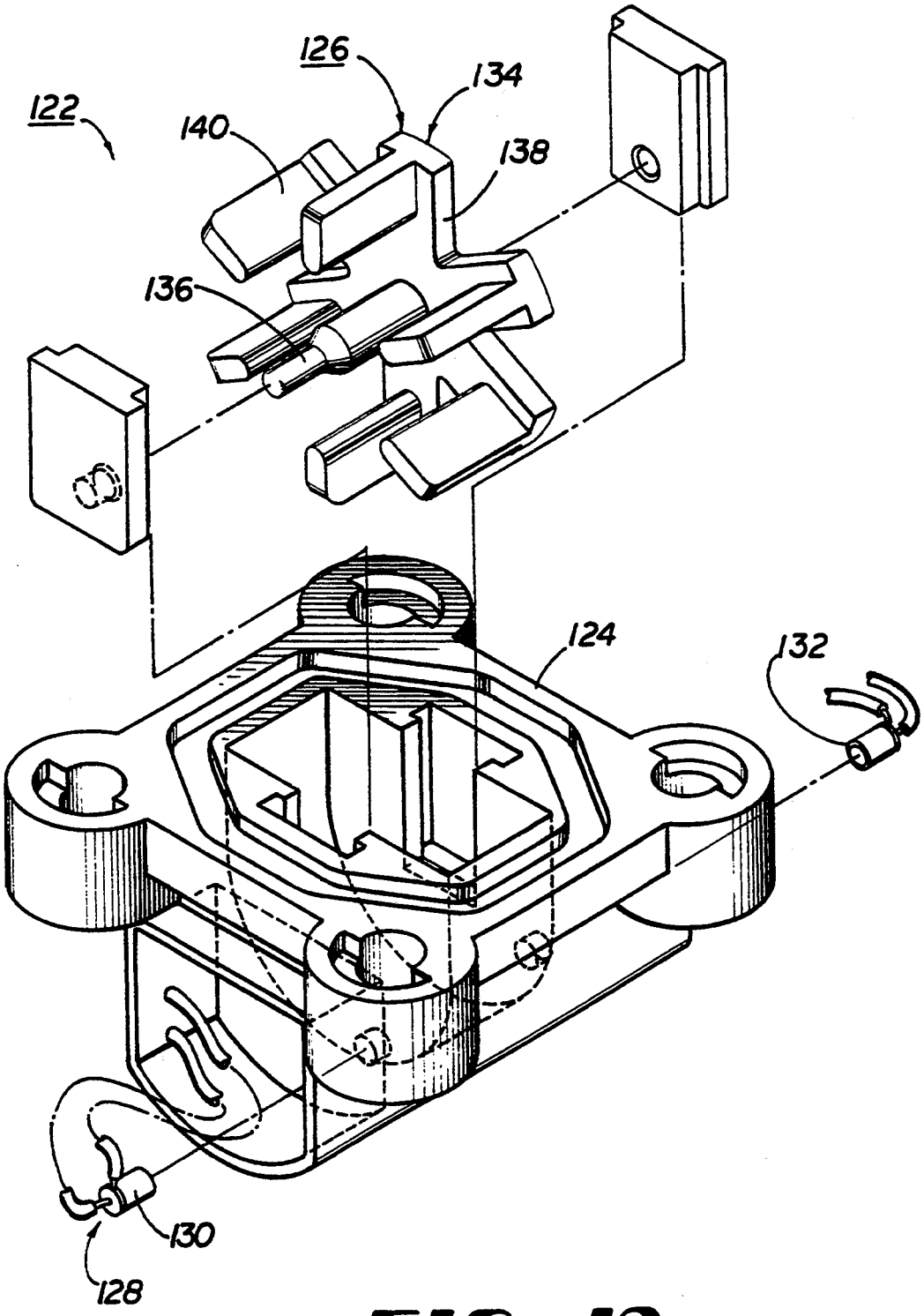
FIG. 10 is a perspective view of the paddle wheel.

Referring now to FIGS. 6–10 there is illustrated a preferred embodiment of a post-mix beverage dispensing valve 100 similar to valve 10 of FIG. 4 except that valve 100 also includes a flow regulator 102 in the syrup conduit 24, and includes the flow meter 122 of FIGS. 8–10. The flow regulator 102 is similar to the flow control device used in most dispensing valves to periodically manually adjust ratio and includes a movable piston 104 biased to its upper position in FIG. 6 by a spring 106, and located in a chamber 108 closed by a plug 110. When pressure increases upstream of the flow regulator, the piston 104 is forced down as shown in FIG. 7 closing some of an exit opening 112 from the chamber 108 and reducing flow.

Figure 15:
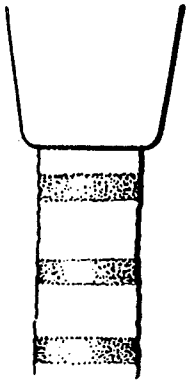
FIG. 15 is a diagrammatic view showing beverage dispensed from the nozzle in accordance with the graph of FIG. 14.
Figure 16:
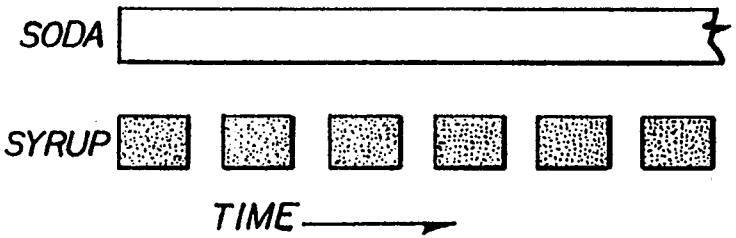
FIG. 16 is a graph similar to FIG. 14 but showing the results of using a different pump.
Figure 17:
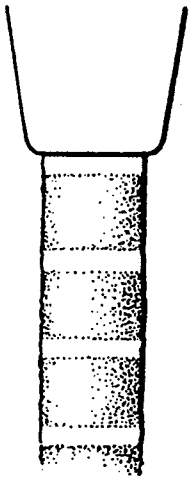
FIG. 17 is a view similar to FIG. 15 but using the flow of FIG. 16.

The flow regulator 102 provides the following advantages. Referring to FIGS. 14–17, FIG. 14 diagrammatically shows the flow of soda and syrup during dispensing with a higher syrup flow rate and FIG. 16 shows the situation with a lower syrup flow rate. FIG. 15 shows diagrammatically the dispensing from a nozzle with the FIG. 14 high syrup flow rate and FIG. 17 shows the situation with the FIG. 16 lower syrup flow rate. The situation shown in FIGS. 16 and 17 is preferred because of better mixing and customer acceptance and improved ratio accuracy. The syrup pressure and flow rate can vary with time; the periods of high flow rate produce the less desirable situation shown in FIGS. 14 and 15. The use of the flow regulator 102 solves this problem and provides the preferred situation shown in FIGS. 16 and 17 at all times, regardless of pressure variations upstream in the syrup line. The flow (or pressure) regulator 102 thus provides the advantages of improved visual acceptance of the dispensing operation, improved mixing, improved foam height, improved drink quality and improved carbonation.

Referring now to FIGS. 8-10, there is illustrated the preferred flow meter 122 in the preferred dispensing valve 120. The flow meter 122 is mounted for rotation in the soda conduit 34 and includes a housing 124, an integral, one-piece, molded paddle wheel 126, and a sensor 128 including a light transmitter 130 and a light receiver 132. The paddle wheel includes six paddles 134 and an axle 136. Each paddle includes a spoke 138 and a flag (paddle) 140. The spokes break the light beam. The spokes are preferably adjacent one axial end of the paddle wheel and the flags extend axially therefrom toward the other end of the paddle wheel.

Figure 11:
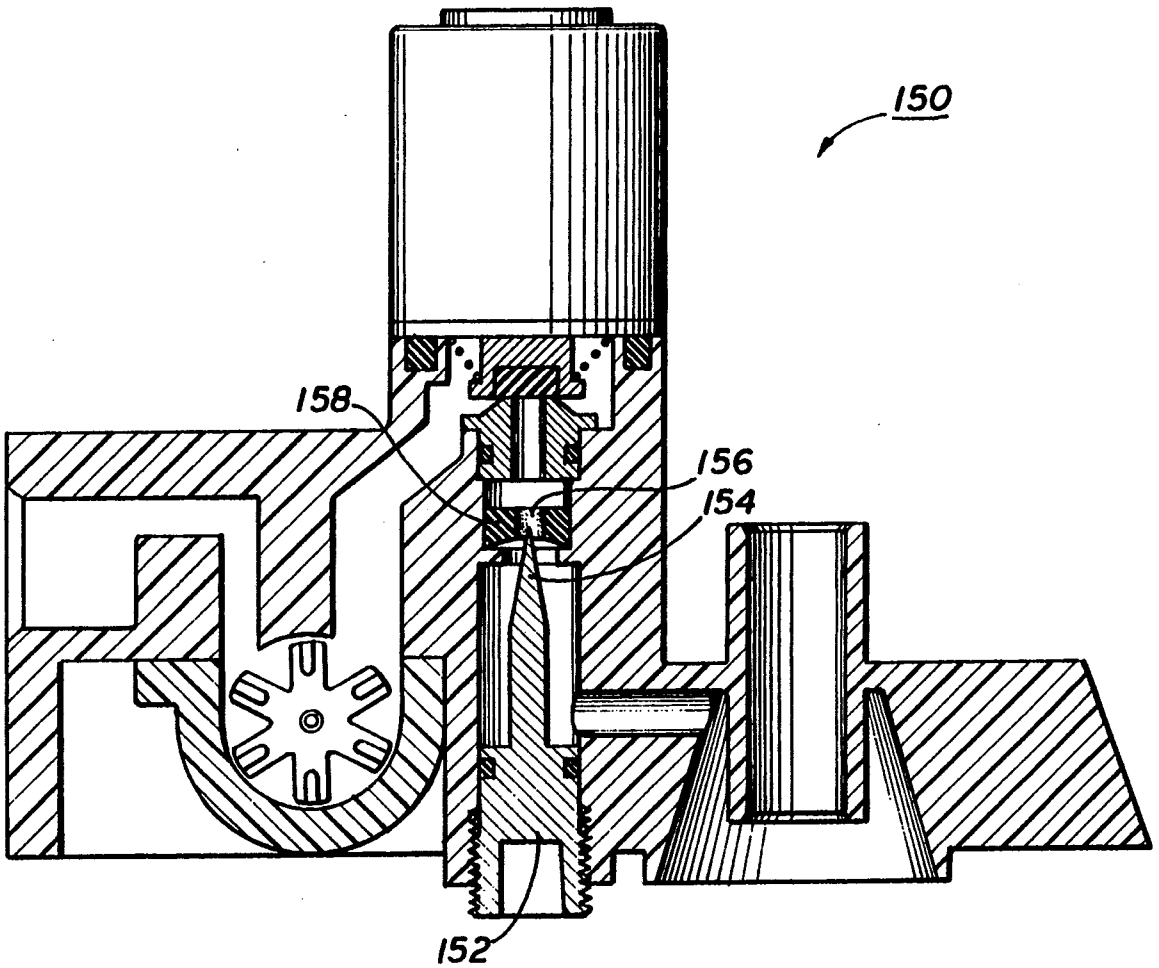
FIG. 11 is a cross-sectional view similar to FIG. 8 but showing an alternative embodiment including an adjustable flow control.

Referring now to FIG. 11, there is illustrated an embodiment of this invention that provides for a manually adjustable variable flow rate. Known dispensing valves operate at a single flow rate, such as either 1½ ounces/-second, 3 ounces/second or 4.5 ounces/second, and have flow controls for adjusting the flow rates a small amount when the ration drifts or gets out of spec. However, known valves can not be switched from one category of flow rate to another by simple manual adjustment. The valve of this invention can, that is, it can dispense at the standard 1½ ounces/second, or the fast flow rate of 3 ounces/second, or the high flow rates of 4½ or 6 ounces/second.

Figure 6:
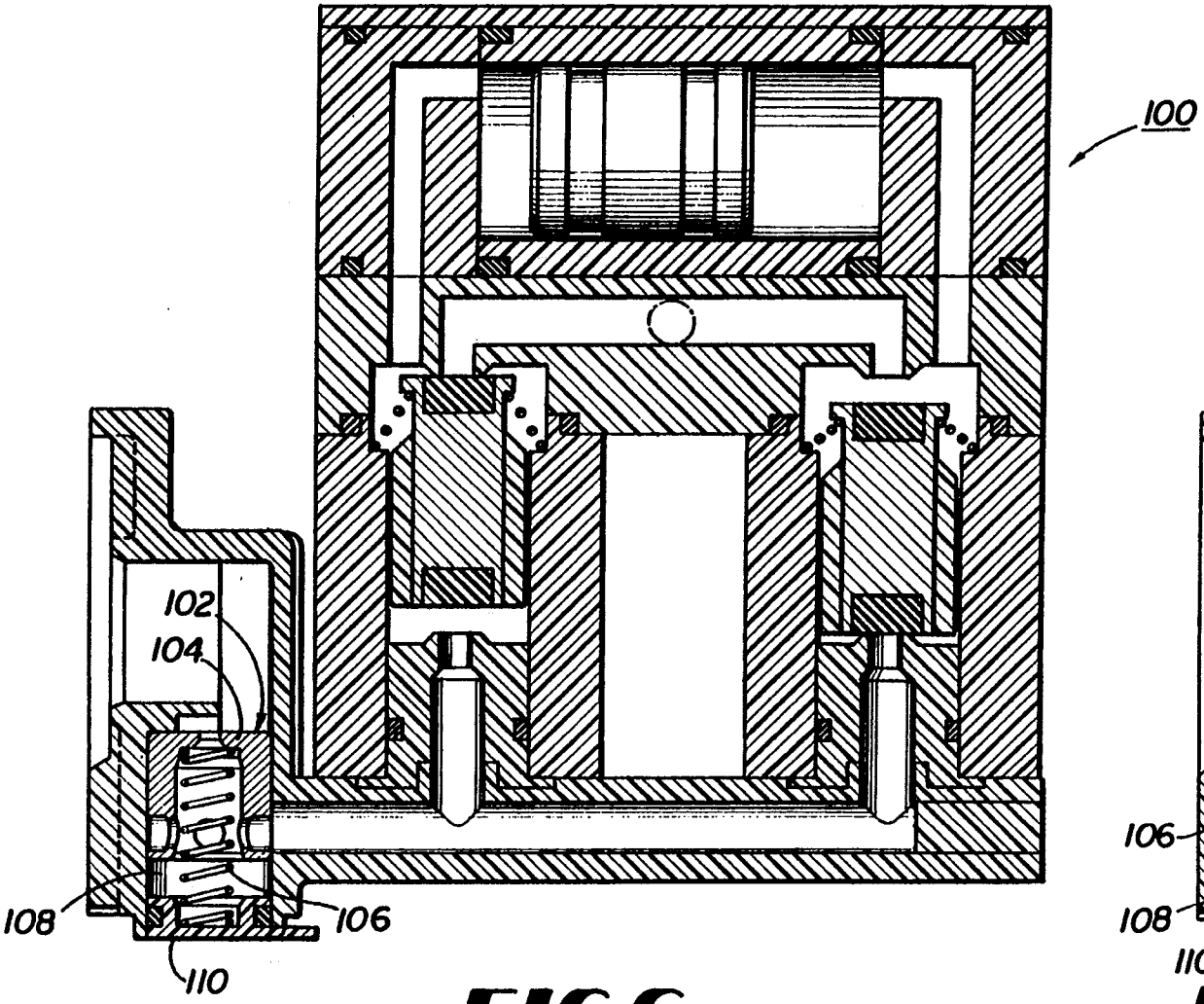
FIG. 6 is a cross-sectional view similar to FIG. 4 but showing a preferred embodiment including a flow regulator in the syrup line.

FIG. 11 shows a valve 150 identical to valve 100 shown in FIGS. 6 and 8, except that the valve 150 also includes a manual adjustment screw 152 adjustable externally of the valve 150 to move the tapered flow control element 154 or needle valve axially into and out of the opening 156 of the flow washer 158 to reduce or increase, respectively, the flow area through the opening 156. This adjustment can be done in a variety of other ways, mechanical and electrical, and can be done from outside the valve or inside the valve as desired, for example, by changing flow washers.

The operation of the preferred valve 100 shown in FIGS. 6–10 is as follows. When the valve 100 is not actuated to dispense a drink, all the solenoids are de-energized and the counter disregards pulses from the sensor. When the valve 100 is actuated to dispense a drink, the following functions occur simultaneously:

(a) the soda solenoid is energized;

(b) the counter totalizes photosensor pulses beginning with the last count of the previous draw. If the pulse rate is less than 100 per second or more than 500 per second, after the valve 100 has been actuated for one second. a warning light is illuminated (non-blinking mode); and (c) the syrup solenoid last energized from the previous draw in energized while the other syrup solenoid remains de-energized.

After a preset count is reached, the following functions occur simultaneously:

(a) the counter resets and starts a new count;

(b) the syrup solenoid that was energized is de-energized;

(c) the syrup solenoid that was de-energized is energized; and (d) if sensors determine that the syrup piston has not reached the end of its stroke before the preset count is reached, a warning light is illuminated (blinking mode).

These functions are repeated as long as the valve 100 is actuated. When the valve 100 is deactuated, the following functions occur simultaneously:

(a) the counter disregards pulses from the photosensor;

(b) all solenoids are deenergized; and (c) the control board remembers the last flow meter count and the last syrup solenoid that was energized.

In the preferred embodiment of FIGS. 6–10, the number of counts for a 5:1 ratio is 68. This can vary, of course, by changing various dimensions in the valve 100. The valve 100 of this invention provides an important advantage over known valves in that it can provide a much larger range of ratios, including very high ratios such as 50:1 by properly sizing the various components. The electronics in this invention can also provide portion control and inventory information, if desired.

Figure 12:
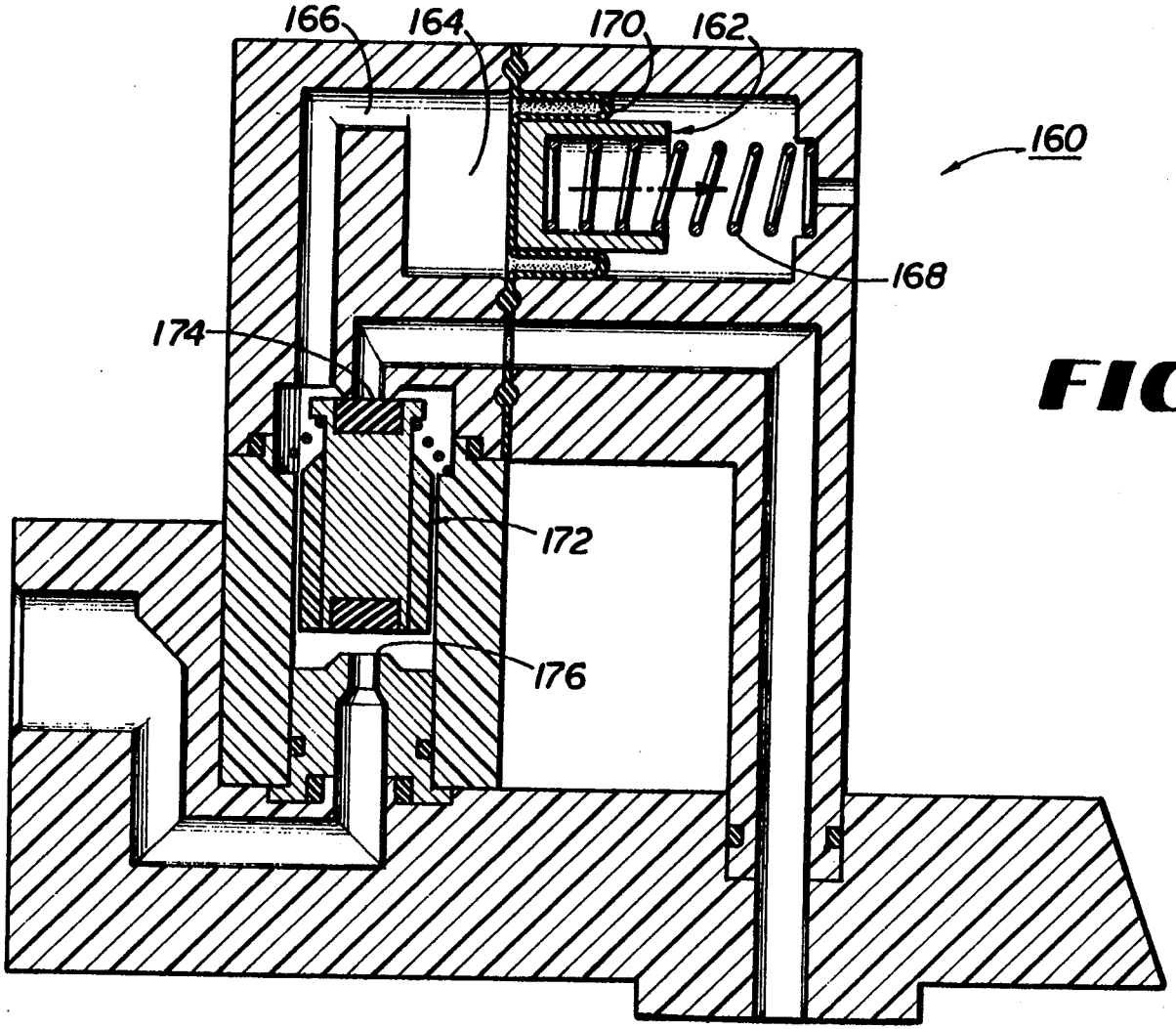
FIG. 12 is a cross-sectional view similar to FIG. 6 but showing an alternative embodiment using a single acting pump rather than a double acting pump.
Figure 13:
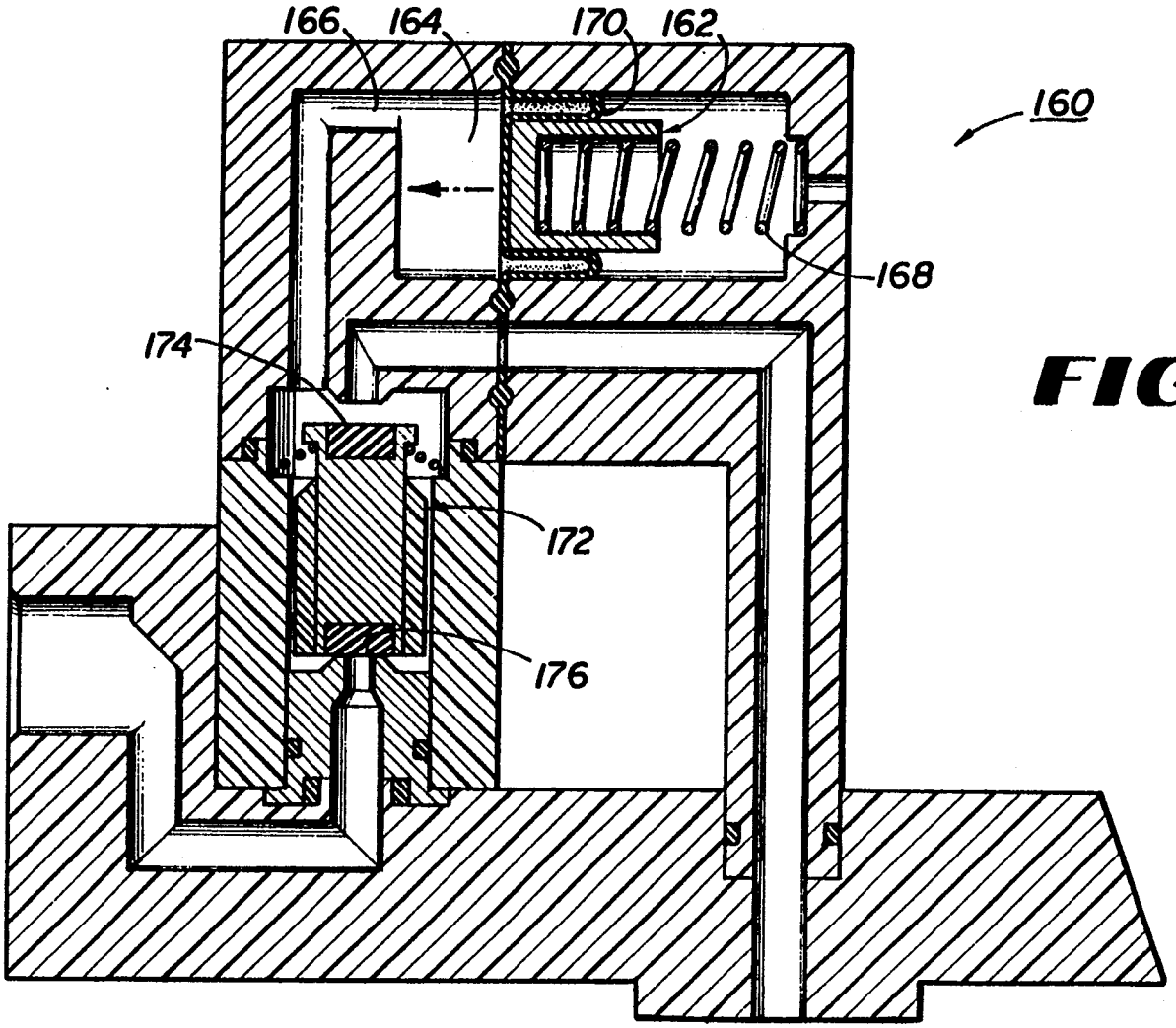
FIG. 13 is a cross-sectional view identical to FIG. 12 but showing the solenoid valve open and the piston moving in the other direction.
Figure 14:
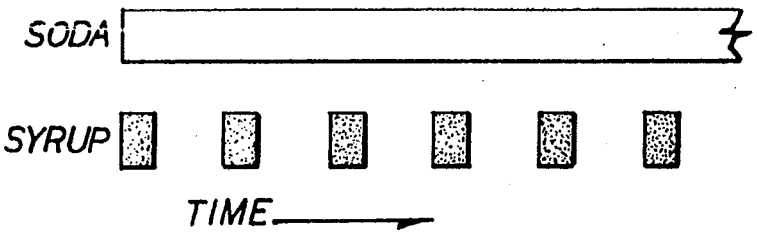
FIG. 14 is a graph showing continuous water flow and intermittent syrup flow.

FIGS. 12 and 13 show another embodiment of the present invention of a valve 160 using a single acting piston 162 rather than the double acting piston of FIGS. 1–11. FIGS. 12 and 13 are views similar to that of FIG. 6 except for the single acting piston 162. The piston 162 reciprocates in a chamber 164 having a single inlet/outlet opening 166. A spring 168 biases the piston 162 toward the left in FIG. 12 and a rolling diaphragm 170 provides a seal. A solenoid valve 172 controls the flow of syrup into and out of the chamber 164. FIG. 12 shows the solenoid 172 de-energized and the chamber 164 filling with syrup. FIG. 13 shows the solenoid energized closing the valve 174 to stop syrup flow into the chamber 164 and opening valve 176 allowing the spring to force syrup to the nozzle 44.

Figure 18:
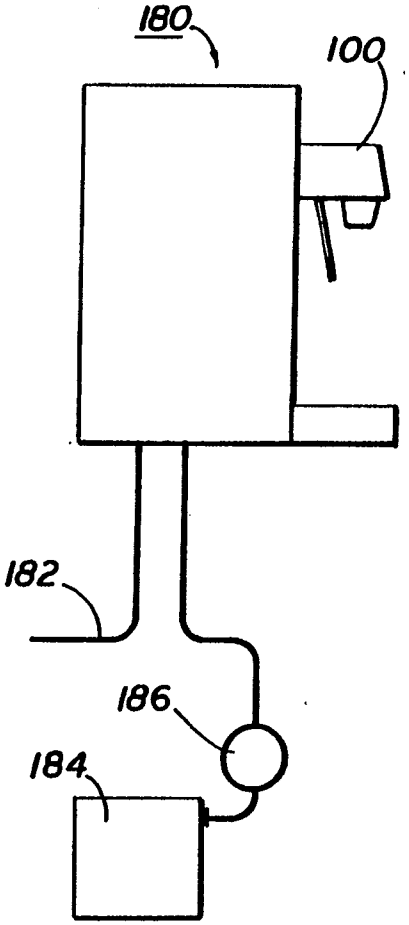
FIG. 18 is a diagrammatic view showing the valve of this invention on a beverage dispenser.

FIG. 18 is a diagrammatic view of a dispenser 180 having the valve 100 thereon and a water line 182 to the dispenser and a syrup container 184 (such as a bag-in-box) and a pump 186 connected to the dispenser.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims. For example, the syrup and the water streams can be fed to a mixing station in the nozzle and dispensed mixed, or they can be dispensed separately into the cup and mix there. The ratio of water to syrup can be in the usual neighborhood of 5:1 or can easily be much higher (such as 50:1), using highly concentrated syrup.

What is claimed is:

1. An apparatus for supplying metered volumes of concentrate and diluent in controlled proportions to a mixing station in a beverage dispenser to produce a post-mix beverage comprising:

a first conduit for accommodating a flow of diluent to the dispenser;

a second conduit for accommodating a flow of concentrate to the dispenser;

flow meter means for measuring a flow rate of diluent in the first conduit and determining a quantity of diluent flowing over a given time interval;

pump means in liquid communication with said second conduit for injecting metered quantities of concentrate into said diluent at said mixing station, said pump means including, a chamber defined by a sleeve of ceramic material, said chamber having first and second distal ends, and a double acting piston formed of ceramic material mounted for reciprocating sliding movement within said sleeve between the distal ends, said sleeve and piston being in close contact and being devoid of any sealing gaskets therebetween;

a pair of inlet passages connecting the second conduit to said chamber on both sides of said piston to apply fluid pressure from said concentrate to opposite sides of said piston;

a pair of outlet passages connecting said chamber to said mixing station;

first valve means operatively connected in one of said pair of inlet passages for permitting the flow of concentrate to said chamber on one side of said piston when in a first position and stopping the flow thereto when in a second position, said second valve means when in said second position also connecting the chamber on said one side of said piston to said mixing station through one of said outlet passages;

second valve means in the other one of said pair of inlet passages for permitting the flow of concentrate to the chamber on the other side of said piston when in a first position and stopping the flow thereto when in a second position, said second valve means when in said second position also connecting the chamber on said other side of said piston to said mixing station through one of said outlet passages; and control means operatively connected to said flow meter means and said first and second valve means for alternately activating said first and second valve means to opposite ones of said first and second positions in response to the measurement of a quantity of diluent flow of a predetermined value, to thereby alternately direct said concentrate to opposite sides of said piston to thereby slide said piston in said chamber from one distal end to the other each time the flow meter measures said predetermined value of the quantity of said diluent;

whereby a fixed volume of concentrate from said chamber is injected into the mixing station and mixed with each quantity of diluent of said predetermined value.

2. The apparatus of claim 1 wherein said flow meter means comprises a housing, fluidly connected in said first conduit to pass diluent therethrough, a paddle wheel disposed in said housing in the flow path of the diluent and rotatable in response to the flow of diluent, sensor means for measuring the rate of rotation of the paddle wheel and generating a series of electrical pulses spaced in proportion to the rate of rotation of the paddle wheel.

3. The apparatus of claim 2 wherein said control means includes counter means for counting said electrical pulses, and generating a trigger signal to switch said first and second valve means to said opposite ones of said first and second positions when the number of pulses counted reaches a threshold number related to the quantity of diluent of said predetermined value.

4. The apparatus of claim 3 wherein said counter means includes means for adjusting the threshold number at which the trigger signal is generated.

5. The apparatus of claim 4 wherein said first and second valve means each comprise electrical solenoids for switching the valve means between said first and second positions in response to said trigger signals generated by said counter means.

6. The apparatus of claim 3 wherein said control means includes rate detector means connected to said counter means for detecting the rate of generation of said electrical pulses by said counter means, limit comparator means for comparing the rate of pulses detected to reference rates including minimum and maximum rates, and signal generator means for generating a warning signal when a pulse rate detected is less than said minimum rate and greater than said maximum rate.

7. The apparatus of claim I wherein said control means includes sensor means for determining if the piston reaches the distal ends of the pump chamber at appropriate times within a dispensing cycle, and warning signal generator means for informing an operator when the piston does not reach the distal ends at the appropriate times.

8. The apparatus of claim 5 wherein each said solenoid valve includes a reciprocating plunger within a surrounding valve housing, one of said inlet passages extending through each valve housing, said plunger having a first valve element on one end thereof and a second valve element on an opposite end thereof, said first valve element blocking said one inlet passage and permitting concentrate flow into an associated outlet passage when said solenoid valve is in said second position, and said second valve element blocking the flow of concentrate through an associated one of said outlet passages and permitting the flow therethrough when in said first position.

9. The apparatus of claim 1 wherein said piston includes at least one ring-shaped groove in the outside surface thereof disposed in a plane substantially orthogonal to the longitudinal axis of the piston.

10. A method for supplying metered volumes of concentrate and diluent in controlled proportions to a mixing station in a beverage dispenser to produce a post-mix beverage comprising the steps of:

supplying diluent to the dispenser through a first conduit;

supplying concentrate to the dispenser through a second conduit;

measuring a flow rate of diluent in the first conduit and determining a quantity of diluent flowing over a given time interval;

providing a pump means in liquid communication with said second conduit for injecting metered quantities of concentrate into said diluent at said mixing station, said pump means including, a chamber defined by a sleeve of ceramic material, said chamber having first and second distal ends, and a double acting piston formed of ceramic material mounted for reciprocating sliding movement within said sleeve between the distal ends. said sleeve and piston being in close contact and being devoid of any sealing gaskets therebetween;

alternately directing concentrate from said second conduit into the chamber on opposite sides of said piston in response to the measurement of a quantity of diluent flow of a predetermined value, to thereby alternately slide said piston in said chamber from one distal end to the other each time the flow meter measures said predetermined value of the quantity of said diluent;

alternately dispensing concentrate from said chamber to said mixing station from the other side of the piston from which concentrate is being directed; and whereby a fixed volume of concentrate from said chamber is injected into the mixing station and mixed with each quantity of diluent of said predetermined value.

11. An apparatus for supplying metered volumes of concentrate and diluent in controlled proportions to a mixing station in a beverage dispenser to produce a post-mix beverage comprising:

a first conduit for accommodating a flow of diluent to the dispenser;

a second conduit for accommodating a flow of concentrate to the dispenser;

flow meter means for measuring a flow rate of diluent in the first conduit and determining a quantity of diluent flowing over a given time interval;

pump means in liquid communication with said second conduit for injecting metered quantities of concentrate into said diluent at said mixing station, said pump means including, a chamber defined by a sleeve, said chamber having first and second distal ends, and a double acting piston mounted for reciprocating sliding movement within said sleeve between the distal ends;

a pair of inlet passages connecting the second conduit to said chamber on both sides of said piston to apply fluid pressure from said concentrate to opposite sides of said piston;

a pair of outlet passages connecting said chamber to said mixing station;

first valve means operatively connected in one of said pair of inlet passages for permitting the flow of concentrate to said chamber on one side of said piston when in a first position and stopping the flow thereto when in a second position, said second valve means when in said second position also connecting the chamber on said one side of said piston to said mixing station through one of said outlet passages;

second valve memos in the other one of said pair of inlet passages for permitting the flow of concentrate to the chamber on the other side of said piston when in a first position and stopping the flow thereto when in a second position, said second valve means when in said second position also connecting the chamber on said other side of said piston to said mixing station through one of said outlet passages; and control means operatively connected to said flow meter means and said first and second valve means for alternately activating said first and second valve means to opposite ones of said first and second positions in response to the measurement of a quantity of diluent flow of a predetermined value, to thereby alternately direct said concentrate to opposite sides of said piston to thereby slide said piston in said chamber from one distal end to the other thereof each time the flow meter measures said predetermined value of quantity of said diluent;

whereby a fixed volume of concentrate from said chamber is injected into the mixing station and mixed with each quantity of diluent of said predetermined value.

12. The apparatus of claim 11 wherein said flow meter means comprises a housing, fluidly connected in said first conduit to pass diluent therethrough, a paddle wheel disposed in said housing in the flow path of the diluent and rotatable in response to the flow of diluent, sensor means for measuring the rate of rotation of the paddle wheel and generating a series of electrical pulses spaced in proportion to the rate of rotation of the paddle wheel.

13. The apparatus of claim 12 wherein said control means includes counter means for counting said electrical pulses, and generating a trigger signal to switch said first and second valve means to said opposite ones of said first and second positions when the number of pulses counted reaches a threshold number related to the quantity of diluent of said predetermined value.

14. The apparatus of claim 13 wherein said counter means includes means for adjusting the threshold number at which the trigger signal is generated.

15. The apparatus of claim 11 wherein said first and second valve means each comprise electrical solenoids for switching the valve means between said first and second positions in response to said trigger signals generated by said counter means.

16. The apparatus of claim 13 wherein said control means includes rate detector means connected to said counter means for detecting the rate of generation of said electrical pulses by said counter means, limit comparator means for comparing the rate of pulses detected to reference rates including minimum and maximum rates, and signal generator means for generating a warning signal when a pulse rate detected is less than said minimum rate and greater than said maximum rate.

17. The apparatus of claim 11 wherein said control means includes sensor means for determining if the piston reaches the distal ends of the pump chamber at appropriate times within a dispensing cycle, and warning signal generator means for informing an operator when the piston does not reach the distal ends at the appropriate times.

18. The apparatus of claim 15 wherein each said solenoid valve includes a reciprocating plunger within a surrounding valve housing, one of said inlet passages extending through each valve housing, said plunger having a first valve element on one end thereof and a second valve element on an opposite end thereof, said first valve element blocking said one inlet passage and permitting concentrate flow into an associated outlet passage when said solenoid valve is in said second position, and said second valve element blocking the flow of concentrate through an associated one of said outlet passages and permitting the flow therethrough when in said first position.

19. The apparatus of claim 11 wherein said piston includes at least one ring-shaped groove in the outside surface thereof disposed in a plane substantially orthogonal to the longitudinal axis of the piston.

20. A method for supplying metered volumes of concentrate and diluent in controlled proportions to a mixing station in a beverage dispenser to produce a post-mix beverage comprising the steps of:

supplying diluent to the dispenser through a first conduit;

supplying concentrate to the dispenser through a second conduit;

measuring a flow rate of diluent in the first conduit and determining a quantity of diluent flowing over a given time interval;

providing a pump means in liquid communication with said second conduit for injecting metered quantities of concentrate into said diluent at said mixing station, said pump means including, a chamber defined by a sleeve, said chamber having first and second distal ends, and a double acting piston mounted for reciprocating sliding movement within said sleeve between the distal ends;

alternately directing concentrate from said second conduit into the chamber on opposite sides of said piston in response to the measurement of a quantity of diluent flow of a predetermined value, to thereby alternately slide said piston in said chamber from one distal end to the other thereof each time the flow meter measures said predetermined value of the quantity of said diluent; and alternately dispensing concentrate from said chamber to said mixing station from the other side of the piston from which concentrate is being directed;

whereby a fixed volume of concentrate from said chamber is injected into the mixing station and mixed with each quantity of diluent of said predetermined value.

21. An apparatus for supplying metered volumes of concentrate and diluent in controlled proportions to a mixing station in a beverage dispenser to produce a post-mix beverage comprising:

a first conduit for accommodating a flow of diluent to the dispenser;

a second conduit for accommodating a flow of concentrate to the dispenser;

flow meter means for measuring a flow rate of diluent in the first conduit and determining a quantity of diluent flowing over a given time interval;

pump means in liquid communication with said second conduit for injecting metered quantities of concentrate into said diluent at said mixing station, said pump means including, a chamber defined by a sleeve of ceramic material, said chamber having first and second distal ends, and a double acting piston formed of ceramic material mounted for reciprocating sliding movement within said sleeve between the distal ends, said sleeve and piston being in close contact and being devoid of any sealing gaskets therebetween; and valve means for alternately directing concentrate from said second conduit into the chamber on opposite sides of said piston in response to measurement by said flow meter of a quantity of diluent flow of a predetermined value, to thereby alternately slide said piston in said chamber from one distal end to the other each time the predetermined value is measured, and alternately dispensing concentrate from said chamber to said mixing station from the other side of the piston from which concentrate is being directed;

whereby a fixed volume of concentrate from said chamber is injected into the mixing station and mixed with each quantity of diluent of said predetermined value.

22. The apparatus of claim 21 wherein said flow meter means comprises a housing, fluidly connected in said first conduit to pass diluent therethrough, a paddle wheel disposed in said housing in the flow path of the diluent and rotatable in response to the flow of diluent, sensor means for measuring the rate of rotation of the paddle wheel and generating a series of electrical pulses spaced in proportion to the rate of rotation of the paddle wheel.

23. The apparatus of claim 21 wherein said flow meter means includes counter means for counting said electrical pulses, and generating a trigger signal to switch said valve means to opposite first and second positions when the number of pulses counted reaches a threshold number related to the quantity of diluent of said predetermined value.

24. The apparatus of claim 23 wherein said counter means includes means for adjusting the threshold number at which the trigger signal is generated.

25. The apparatus of claim 23 wherein said control means includes rate detector means connected to said counter means for detecting the rate of generation of said electrical pulses by said counter means, limit comparator means for comparing the rate of pulses detected to reference rates including minimum and maximum acceptable rates, and signal generator means for generating a warning signal when a pulse rate detected is less than said minimum rate and greater than said maximum rate.

26. The apparatus of claim 21 wherein said control means includes sensor means for determining if the piston reaches the distal ends of the pump chamber at appropriate times within a dispensing cycle, and warning signal generator means for informing an operator when the piston does not reach the distal ends at the appropriate times.

27. The apparatus of claim 24 wherein each said solenoid valve includes a reciprocating plunger within a surrounding valve housing, one of said inlet passages extending through each valve housing, said plunger having a first valve element on one end thereof and a second valve element on an opposite end thereof, said first valve element blocking said one inlet passage and permitting concentrate flow into an associated outlet passage when said solenoid valve is in said second position, and said second valve element blocking the flow of concentrate through an associated one of said outlet passages and permitting the flow therethrough when in said first position.

28. The apparatus of claim 21 wherein said piston includes at least one ring-shaped groove in the outside surface thereof disposed in a plane substantially orthogonal to the longitudinal axis of the piston.

29. An apparatus for supplying metered volumes of concentrate and diluent in controlled proportions to a mixing station in a beverage dispenser to produce a post-mix beverage comprising:

a first conduit for accommodating a flow of diluent to the dispenser;

a second conduit for accommodating a flow of concentrate to the dispenser;

flow meter means for measuring a flow rate of diluent in the first conduit and determining a quantity of diluent flowing over a given time interval;

pump means in liquid communication with said second conduit for injecting metered quantities of concentrate into said diluent at said mixing station, said pump means including, a chamber defined by a sleeve, said chamber having first and second distal ends, and a double acting piston mounted for reciprocating sliding movement within said sleeve between the distal ends; and valve means for alternately directing concentrate from said second conduit into the chamber on opposite sides of said piston in response to measurement by said flow meter of a quantity of diluent flow of a predetermined value, to thereby alternately slide said piston in said chamber from one distal end to the other each time the predetermined value is measured, and alternately dispensing concentrate from said chamber to said mixing station from the other side of the piston from which concentrate is being directed;

whereby a fixed volume of concentrate from said chamber is injected into the mixing station and mixed with each quantity of diluent of said predetermined value.

30. The apparatus of claim 29 wherein said flow meter means comprises a housing, fluidly connected in said first conduit to pass diluent therethrough, a paddle wheel disposed in housing said in the flow path of the diluent and rotatable in response to the flow of diluent, and sensor means for measuring the rate of rotation of the paddle wheel and generating a series of electrical pulses spaced in proportion to the rate of rotation of the paddle wheel.

31. The apparatus of claim 30 wherein said flow meter means includes counter means for counting said electrical pulses, and generating a trigger signal to switch said valve means to opposite first and second positions when the number of pulses counted reaches a threshold number related to the quantity of diluent of said predetermined value.

32. The apparatus of claim 31 wherein said counter means includes means for adjusting the threshold number at which the trigger signal is generated.

33. The apparatus of claim 31 wherein said control means includes rate detector means connected to said counter means for detecting the rate of generation of said electrical pulses by said counter means, limit comparator means for comparing the rate of pulses detected to reference rates including minimum and maximum acceptable rates, and signal generator means for generating a warning signal when a pulse rate detected is less than said minimum rate and greater than said maximum rate.

34. The apparatus of claim 29 wherein said control means includes sensor means for determining if the piston reaches the distal ends of the pump chamber at appropriate times within a dispensing cycle, and warning signal generator means for informing an operator when the piston does not reach the distal ends at the appropriate times.

35. The apparatus of claim 29 wherein said piston includes at least one ring-shaped groove in the outside surface thereof disposed in a plane substantially orthogonal to the longitudinal axis of the piston.

36. A postmix beverage dispensing valve comprising:

(a) a valve body having a concentrate conduit and a separate water conduit therethrough;

(b) flow meter means in said water conduit for generating signals corresponding to the volume of water flowing through said water conduit;

(c) a solenoid valve in said water conduit;

(d) a volumetric pump in said syrup conduit for dispensing from said dispensing valve a predetermined volume of syrup for each pumping stroke, and a solenoid valve control system for controlling the operation of said pump;

(e) control means operatively connected to said flow meter means and to said solenoid valve control system for operating said pump in response to measured volumes of water flowing through said water conduit, whereby a predetermined volume of syrup is dispensed from said pump whenever a predetermined measured volume of water flows through said flow meter means; and (f) a flow regulator in said concentrate conduit upstream of said pump.

37. The apparatus as recited in claim 36 wherein said flow regulator is nonadjustable.

38. A postmix beverage dispensing valve comprising:

(a) a valve body having a concentrate conduit and a separate water conduit therethrough;

(b) flow meter means in said water conduit for generating signals corresponding to the volume of water flowing through said water conduit;

(c) a solenoid valve in said water conduit;

(d) a volumetric pump in said syrup conduit for dispensing from said dispensing valve a predetermined volume of syrup for each pumping stroke, and a solenoid valve control system for controlling the operation of said pump;

(e) control means operatively connected to said flow meter means and to said solenoid valve control system for operating said pump in response to measured volumes of water flowing through said water conduit, whereby a predetermined volume of syrup is dispensed from said pump whenever a predetermined measured volume of water flows through said flow meter means, and (f) an adjustable flow control in said water conduit for controlling the flow rate of beverage dispensed from said valve.

39. The apparatus as recited in claim 38 wherein said flow control is manually adjustable externally of said valve.

40. The apparatus as recited in claim 38 wherein said flow control is downstream from said solenoid in said water conduit.

41. The apparatus as recited in claim 38 wherein said flow control is an axially movable needle valve positioned in a central opening in a flow washer in said water conduit.

42. A postmix beverage dispensing valve comprising:

(a) a valve body having a concentrate conduit and a separate water conduit therethrough;

(b) flow meter means in said water conduit for generating signals corresponding to the volume of water flowing through said water conduit;

(c) a solenoid valve in said water conduit;

(d) a volumetric pump in said syrup conduit for dispensing from said dispensing valve a predetermined volume of syrup for each pumping stroke, and a solenoid valve control system for controlling the operation of said pump;

(e) control means operatively connected to said flow meter means and to said solenoid valve control system for operating said pump in response to measured volumes of water flowing through said water conduit, whereby a predetermined volume of syrup is dispensed from said pump whenever a predetermined measured volume of water flows through said flow meter means; and (f) said volumetric pump including a single acting pump and said solenoid valve control system comprising a single solenoid.

43. A postmix beverage dispensing valve comprising:

(a) a valve body having a concentrate conduit and a separate water conduit therethrough;

(b) flow meter means in said water conduit for generating signals corresponding to the volume of water flowing through said water conduit;

(c) a solenoid valve in said water conduit;

(d) a volumetric pump in said syrup conduit for dispensing from said dispensing valve a predetermined volume of syrup for each pumping stroke, and a solenoid valve control system for controlling the operation of said pump;

(e) control means operatively connected to said flow meter means and to said solenoid valve control system for operating said pump in response to measured volumes of water flowing through said water conduit, whereby a predetermined volume of syrup is dispensed from said pump whenever a predetermined measured volume of water flows through said flow meter means;

(f) said volumetric pump including a single acting pump and said solenoid valve control system comprising a single solenoid; and (g) said single solenoid including an armature having a poppet valve at each end thereof.

44. A postmix beverage dispensing valve comprising:

(a) a valve body having a concentrate conduit and a separate water conduit therethrough;

(b) flow meter means in said water conduit for generating signals corresponding to the volume of water flowing through said water conduit;

(c) a solenoid valve in said water conduit;

(d) a volumetric pump in said syrup conduit for dispensing from said dispensing valve a predetermined volume of syrup for each pumping stroke, and a solenoid valve control system for controlling the operation of said pump;

(e) control means operatively connected to said flow meter means and to said solenoid valve control system for operating said pump in response to measured volumes of water flowing through said water conduit, whereby a predetermined volume of syrup is dispensed from said pump whenever a predetermined measured volume of water flows through said flow meter means; and (f) wherein said pump is a double acting pump including a piston and said solenoid valve control system including a pair of solenoid valves, and sensor means for determining the position of said piston and said control means including means for switching the energization of said pair of solenoids every time said piston reaches the end of its travel in each direction.

45. A postmix beverage dispensing valve comprising:

(a) a valve body having a concentrate conduit and a separate water conduit therethrough;

(b) flow meter means in said water conduit for generating signals corresponding to the volume of water flowing through said water conduit;

(c) a solenoid valve in said water conduit;

(d) a volumetric pump in said syrup conduit for dispensing from said dispensing valve a predetermined volume of syrup for each pumping stroke, and a solenoid valve control system for controlling the operation of said pump;

(e) control means operatively connected to said flow meter means and to said solenoid valve control system for operating said pump in response to measured volumes of water flowing through said water conduit, whereby a predetermined volume of syrup is dispensed from said pump whenever a predetermined measured volume of water flows through said flow meter means;

(f) wherein said pump is a double acting pump including a piston and said solenoid valve control system including a pair of solenoid valves, and sensor means for determining the position of said piston and said control means including means for switching the energization of said pair of solenoids every time said piston reaches the end of its travel in each direction; and (g) said control means including means, when said valve is deactuated, for storing the information as to which of said pair of solenoids was energized.

46. The apparatus as recited in claim 45 wherein said control means, when said valve is actuated, energizes the same one of said pair of solenoids that was last energized.

47. The apparatus as recited in claim 46 wherein said control means includes means for storing the last count from said flow meter means when said valve is deactuated.

48. The apparatus as recited in claim 47 wherein said control means, when said valve is reactuated, starts counting at the count stored when said valve was deactuated.

49. A postmix beverage dispensing valve comprising:

(a) a valve body having a concentrate conduit and a separate water conduit therethrough;

(b) flow meter means in said water conduit for generating signals corresponding to the volume of water flowing through said water conduit;

(c) a solenoid valve in said water conduit;

(d) a volumetric pump in said syrup conduit for dispensing from said dispensing valve a predetermined volume of syrup for each pumping stroke, and a solenoid valve control system for controlling the operation of said pump;

(e) control means operatively connected to said flow meter means and to said solenoid valve control system for operating said pump in response to measured volumes of water flowing through said water conduit, whereby a predetermined volume of syrup is dispensed from said pump whenever a predetermined measured volume of water flows through said flow meter means; and (f) wherein said flow meter means includes a single, integral, molded paddle wheel including at least six paddles and an axle, each paddle being identical and including a radial spoke adjacent one axial end of said paddle wheel and a flag extending axially from said spoke toward the other axial end of said paddle wheel.

50. The apparatus as recited in claim 49 wherein said flow meter means includes a light transmitter for directing a light beam parallel to the axis of said paddle wheel and a light receiver for receiving said light beam and wherein each of said paddles interrupts said light beam.

51. A postmix beverage dispensing valve comprising:

(a) a valve body having a concentrate conduit and a separate water conduit therethrough;

(b) flow meter means in said water conduit for generating signals corresponding to the volume of water flowing through said water conduit:

(c) a solenoid valve in said water conduit;

(d) a volumetric pump in said syrup conduit for dispensing from said dispensing valve a predetermined volume of syrup for each pumping stroke, and a solenoid valve control system for controlling the operation of said pump;

(e) control means operatively connected to said flow meter means and to said solenoid valve control system for operating said pump in response to measured volumes of water flowing through said water conduit, whereby a predetermined volume of syrup is dispensed from said pump whenever a predetermined measured volume of water flows through said flow meter means; and (f) wherein said control means includes means for storing the last count from said flow meter means when said valve is deactuated.

52. A postmix beverage dispensing valve comprising:

(a) a valve body having a concentrate conduit and a separate water conduit therethrough;

(b) flow meter means in said water conduit for generating signals corresponding to the volume of water flowing through said water conduit;

(c) a solenoid valve in said water conduit;

(d) a volumetric pump in said syrup conduit for dispensing from said dispensing valve a predetermined volume of syrup for each pumping stroke, and a solenoid valve control system for controlling the operation of said pump;

(e) control means operatively connected to said flow meter means and to said solenoid valve control system for operating said pump in response to measured volumes of water flowing through said water conduit, whereby a predetermined volume of syrup is dispensed from said pump whenever a predetermined measured volume of water flows through said flow meter means; and (f) wherein said control means includes means for storing the last count from said flow meter means when said valve is deactuated, and when said valve is reactuated, for starting counting at the count stored when said valve was deactuated.

* * * * *